US006854516B2

(12) United States Patent
Nish et al.

(10) Patent No.: US 6,854,516 B2
(45) Date of Patent: Feb. 15, 2005

(54) RISER BUOYANCY SYSTEM

(75) Inventors: Randall Williams Nish, Provo, UT (US); Metin Karayaka, Houston, TX (US)

(73) Assignee: Technip France, Courbevoie (FR)

( * ) Notice: Subject to any disclaimer, the term of this patent is extended or adjusted under 35 U.S.C. 154(b) by 18 days.

(21) Appl. No.: 10/616,152

(22) Filed: Jul. 9, 2003

(65) Prior Publication Data

US 2004/0026082 A1 Feb. 12, 2004

Related U.S. Application Data

(63) Continuation of application No. 10/061,086, filed on Jan. 31, 2002, now abandoned.

(51) Int. Cl.[7] ..... E21B 29/12

(52) U.S. Cl. ..... 166/350; 166/367; 405/171; 441/133

(58) Field of Search ..... 441/133; 405/171, 405/223.1, 223.2, 223.4; 114/266, 264; 166/367, 368, 350

(56) References Cited

U.S. PATENT DOCUMENTS

| | | | | |
|---|---|---|---|---|
| 3,858,401 | A | | 1/1975 | Watkins |
| 3,957,112 | A | | 5/1976 | Knibbe et al. |
| 4,057,450 | A | | 11/1977 | Lee |
| 4,102,142 | A | | 7/1978 | Lee |
| 4,176,984 | A | | 12/1979 | Sommers |
| 4,386,919 | A | * | 6/1983 | Kadono ..... 441/133 |
| 4,646,840 | A | | 3/1987 | Bartholomew et al. |
| 4,702,321 | A | | 10/1987 | Horton |
| 4,821,804 | A | | 4/1989 | Pierce |
| 5,706,897 | A | | 1/1998 | Horton |
| 5,758,990 | A | | 6/1998 | Davies et al. |
| 5,873,416 | A | | 2/1999 | Horton |
| 5,881,815 | A | | 3/1999 | Horton |
| 6,004,074 | A | | 12/1999 | Shanks, II |
| 6,092,483 | A | | 7/2000 | Allen et al. |
| 6,155,748 | A | | 12/2000 | Allen et al. |
| 6,161,620 | A | | 12/2000 | Cox et al. |
| 6,270,387 | B1 | * | 8/2001 | Nesheim ..... 441/133 |
| 6,347,912 | B1 | * | 2/2002 | Thomas ..... 405/224.2 |
| 6,367,846 | B1 | | 4/2002 | Aaron, III |
| 6,406,223 | B1 | | 6/2002 | Thomas |
| 6,435,775 | B1 | | 8/2002 | Nish et al. |
| 6,439,810 | B1 | | 8/2002 | Nish et al. |
| 6,488,447 | B1 | | 12/2002 | Nish et al. |

FOREIGN PATENT DOCUMENTS

| | | |
|---|---|---|
| WO | WO 02/04855 | 1/2002 |

* cited by examiner

*Primary Examiner*—Thomas B. Will
*Assistant Examiner*—Thomas A Beach
(74) *Attorney, Agent, or Firm*—Klein, O'Neill & Singh, LLP; Howard J. Klein

(57) ABSTRACT

A frame and system for adding buoyancy to a riser used in connection with floating platforms is provided which, in some example embodiments, includes a stem attached to multiple supports which include flanges arranged to take impact and abrasion loads off an internal buoyancy module. An air management system is also provided.

4 Claims, 7 Drawing Sheets

RISER BUOYANCY SYSTEM

CROSS-REFERENCE TO RELATED APPLICATION

The present application is a continuation of U.S. patent Ser. No. 10/061,086, filed Jan. 31, 2002, abandoned.

BACKGROUND

The present invention relates to buoyancy "cans" used to provide uplift force to top-tensional risers.

Vast oil reservoirs have recently been discovered in very deep waters around the world, principally in the Gulf of Mexico, Brazil and West Africa. Water depths for these discoveries range from 1500 to nearly 10,000 ft. Conventional offshore oil production methods using a fixed, truss-type platform are not suitable for these water depths, where these platforms become dynamically active (flexible). Stiffening them to avoid excessive and damaging dynamic responses to wave forces is prohibitively expensive.

Deep water oil and gas production has thus turned to new technologies based on floating production systems. These systems come in several forms, but all of them rely on buoyancy for support and some form of a mooring system for lateral restraint against the environmental forces of wind, waves and current.

These floating production systems (FPS) sometimes are used for drilling as well as production. They are also sometimes used for storing oil for offloading to a tanker. This is most common in Brazil and West Africa, but not in Gulf of Mexico as of yet. In the Gulf of Mexico, oil and gas are exported through pipelines to shore.

Drilling, production and export all require some form of vertical conduit through the water column between the sea floor and the FPS. These conduits are usually in the form of pipes which are called "risers." Typical risers are either vertical (or nearly vertical) pipes held up at the surface by tensioning devices; supported at the top and formed in a modified catenary shape to the sea bed; or steel pipe which is also supported at the top and configured in a catenary to the sea bed (Steel Catenary Risers—commonly known as SCRs).

The flexible and SCR type risers are, in most cases, directly attached to the floating vessel. Their catenary shapes allow them to comply with the motions of the FPS due to environmental forces. These motions can be as much as 10–20% of the water depth horizontally, and 10s of ft vertically, depending on the type of vessel, mooring and location.

Top-tensioned risers (TTRs) typically need to have higher tensions than the flexible risers, and the vertical motions of the vessel need to be isolated from the risers. TTRs have significant advantages for production over the other forms of risers, however, because they allow the wells to be drilled directly from the FPS, avoiding an expensive separate floating drilling rig.

TTR tensioning systems are a technical challenge, especially in very deep water where the required top tensions can be 1000 tons or more. Some types of FPS vessels, e.g. ship-shaped hulls, have extreme motions which are too large for TTRs. These types of vessels are only suitable for flexible risers. Other, low-heave (vertical motion) FPS designs are suitable for TTRs. This includes tension-leg platforms (TLPs), semi-submersibles and SPARs, all of which are in service today.

Of these, only the TLP and SPAR platforms use TTR production risers. Semi-submersibles use TTRs for drilling risers, but these must be disconnected in extreme weather. Production risers need to be designed to remain connected to the seabed in extreme events, typically the 100 year return period storm. Only very stable vessels are suitable for this.

SPAR-type platforms recently used in the Gulf of Mexico use a passive means for tensioning the risers. These types of platforms have a very deep draft with a centerwell, through which the risers pass. Buoyancy cans inside the centerwell provide the top tension for the risers. See, e.g., U.S. Pat. Nos. 5,873,416, 5,881,815, and 5,706,897, all of which are incorporated herein by reference.

Buoyancy cans are typically cylindrical, and they are separated from each other by a rectangular guide structure. These guides are attached to the hull. As the hull moves, the risers are deflected horizontally with the guides. However, the risers are tied to the seafloor; hence, as the vessel heaves, the guides slide up and down relative to the buoyancy can and risers (from the viewpoint of a person on the vessel it appears as if the risers are sliding in the guides).

Referring now to FIG. 1, a typical top-tensioned riser is seen. A wellhead at the sea floor connects the well casing (below the sea floor) to the riser with a tieback connector. The riser, typically a 9–14" pipe, passes from the tieback connector through the bottom of the SPAR and into the centerwell. Inside the centerwell the riser passes through a stem pipe, or conduit, which goes through the center of the buoyancy cans. This stem extends above the buoyancy cans themselves and are connected to the surface tree. The buoyancy cans need to provide enough buoyancy to support the required top tension in the risers, the weight of the cans and stem, and the weight of the surface wellhead. Since the surface wellhead ("dry tree") move up and down, relative to the vessel, flexible jumper lines connect the wellhead to a manifold which carries the product to a processing facility to separate water, oil and gas from the well stream.

The underlying principal of buoyancy cans is to remove a load-bearing connection between the floating vessel and the risers. As production and drilling developments go deeper, the connection problem between risers and the floating structure becomes more complex. Buoyancy cans eliminate the need for a load-bearing connection between the two; the cans hold the weight of the riser. The risers are connected to the vessel by flexible pipes that do not hold the riser.

Buoyancy cans are designed to accommodate the weight they need to support and the environmental conditions they are expected to encounter (including specific static and dynamic forces that act on the cans due to the relative motion between the vessel and the cans). Typical buoyancy can designs use steel to resist side-loads due to dynamic motion between the riser and the vessel. As depth increases, the size of conventional buoyancy cans increases along with the thickness of the buoyancy can wall to resist increased pressure at depth. These conditions lead to an increase in thickness of the wall of the buoyancy can, and thus an increase in the weight and cost of the buoyancy can. Furthermore, as the buoyancy can moves within a vessel riser bay, the buoyancy can surface and the guide move against each other in a constant sliding action.

Typical buoyancy cans comprise a large steel sheet rolled to form a pipe around the stem of the riser arrangement. End caps, as well as horizontal bulk heads, are used to transfer the uplift force to the riser arrangement It is difficult and expensive to manufacture buoyancy cans with such a configuration. Thus, there is a need for a simpler design for buoyancy cans, simpler methods of manufacturing buoyancy cans, and there is a need for a lighter buoyancy can. Furthermore, there is a need for a buoyancy can that is cheaper to build, smaller in diameter and length, and easier to fabricate and install.

SUMMARY OF THE INVENTION

The present invention allows a reduction in the cost and weight of the buoyancy cans as the invention removes the need for each individual module to resist side-loads. This invention further provides more buoyancy in a fixed space, or equivalent buoyancy in a smaller space, when compared to a traditional buoyancy can.

According to one aspect of the invention, a frame is provided onto which buoyancy modules are attached. According to one example, the frame comprises support members, spaced substantially radially from a center axis, for attachment to a riser stem or to a riser directly. Flanges are attached in various embodiments to provide wear resistance and for transfer of side loads.

A buoyancy system for use with a riser is also provided, the system comprising: a means for trapping air underwater, a means for holding the means for trapping air underwater in load-transferring contact with the riser, and at least two substantially longitudinally and substantially radially extending members connected to the means for holding, positioned and arranged to transfer side-loads to the riser. According to one embodiment of the invention, the substantially longitudinal and substantially radial members are attached to the riser. In an alternative embodiment, the longitudinal and radial members are attached to a riser stem.

According to a further embodiment of the invention, the longitudinal and radial members are intermittently-spaced along the means for trapping air at locations where contact with riser guides is anticipated. In still another embodiment of the invention, the means for trapping air underwater comprises a plurality of composite modules; and, in yet a further alternative embodiment, the means for trapping air underwater comprises a curved metal plate attached to flanges located on the longitudinal and radially-extending members.

According to an even further embodiment of the invention, the flanges include a wear-resistant material on the surface of the flanges, and the buoyancy module extends no further than the outer surface of the flanges.

A more specific embodiment of the invention comprises third and fourth substantially longitudinally and substantially radially extending members connected to the means for holding.

According to even further embodiments of the invention, an air management system, connected to the modules, is provided; and horizontal bulkheads, located at the top and bottom of the means for trapping air, are also included in various embodiments.

DESCRIPTION OF THE EXAMPLE EMBODIMENTS OF THE INVENTION

Figure 2:
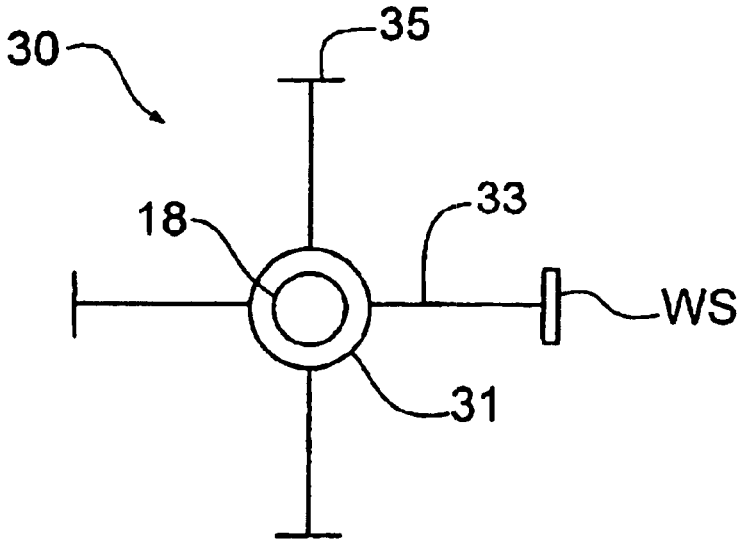
FIG. 2 shows a sectional view of an embodiment of the invention.

Referring now to FIG. 2, according to one aspect of the present inventions, a frame 30 is provided. In some embodiments, frame 30 comprises a stem pipe 31; although, in alternative embodiments, the frame is connected to the riser 18, itself. The particular example shown of frame 30 comprises a support 33 which extends radially and longitudinally from the stem pipe 31. Flange 35 is attached to support 33. Frame 30 comprises the structure around which a buoyancy system, according to an example embodiment, is constructed.

Figure 3:
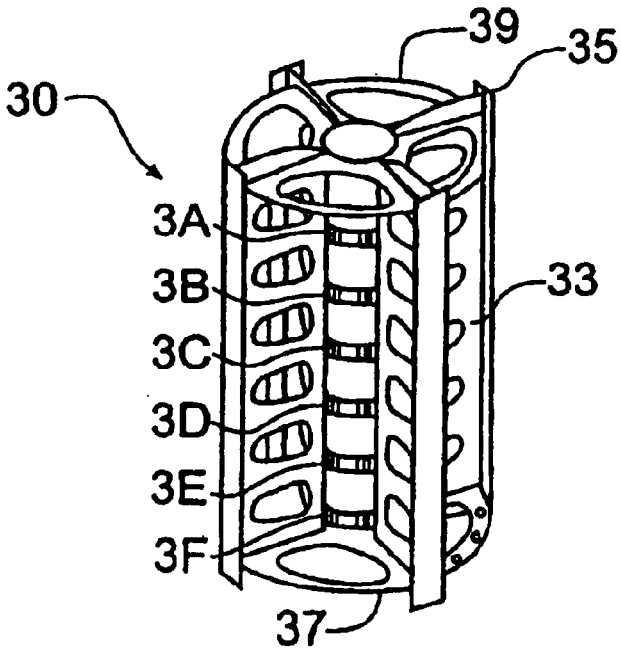
FIG. 3 shows a perspective view of an embodiment of the invention.

FIG. 3 shows a perspective view of a frame 30 in which like components are illustrated with like numbers. Horizontal bulkhead 37 and horizontal bulkhead 39 are attached to support 33 and flange 35.

In various further embodiments of the invention, flange 35 comprises a solid strip of steel, coated with anti-wear material (for example, bronze, ultra-high molecular weight polyethylene, and/or Teflon®). Alternatively, flange 35 includes an integrally formed outer surface of anti-wear material; while, in still another embodiment, the wear material WS (FIG. 2) is welded to the flange. Support 33 comprises metal plate, in various embodiments. In the example seen in FIG. 3, voids are formed in support 33, making it a web for reduction of overall weight of the resulting buoyancy can. The framework formed by the support 33 and flanges 35 forms a stiff backbone structure capable of resisting hydrodynamic and inertial loads that are imposed on the buoyancy system. The transverse bulkheads 37 and 39 stabilize the T-beam members formed by supports 33 and flanges 35, preventing lateral buckling of supports 33. The wear material on the surface of the T-beam endures abrasion loads caused by the relative motions between the buoyancy cans and the vessel. Further, the T-beams transfer the side-loads caused by vessel motion through the T-beam, into the center pipe 31, and throughout the frame structure 30, rather than having the load transferred directly through a wall. Further still, the T-beams react to bending forces caused by lateral side-loads and hydrodynamic forces acting on the structure.

Figure 4:
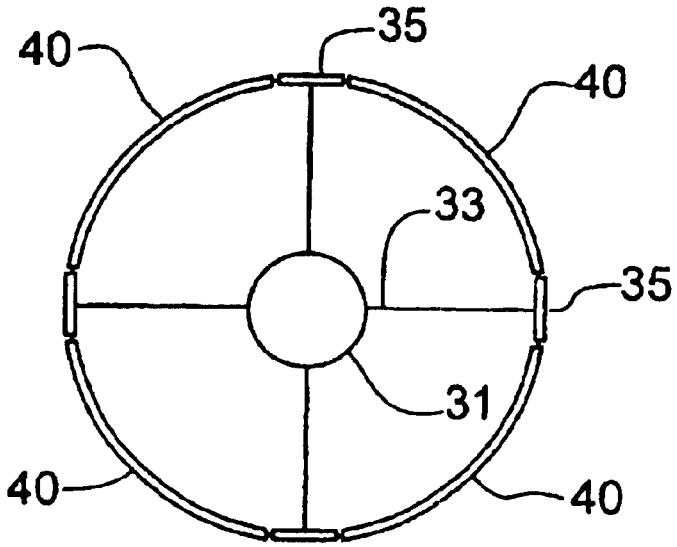
FIG. 4 shows a sectional view of an embodiment of the invention.

Referring now to FIG. 4, a cross-sectional view of a particular example embodiment is seen in which four walls 40 are provided, attached to flanges 35, to enclose the volume defined by supports 33 and flanges 35. In the illustrated example, walls 40 in conjunction with supports 33, stem pipe 31, and flanges 35, trap air that is required for buoyancy. Walls 40, when made of steel, add stiffness to the buoyancy can structure. In an alternative example (not shown), a wall surrounds the structure, including flanges 35. In some cases, bulkheads 37 or 39 (FIG. 3) are solid and sealed with wall 40. In further examples, bulkheads 37 or 38 are used in conjunction with other caps for isolating the volume from the sea.

Figure 5:
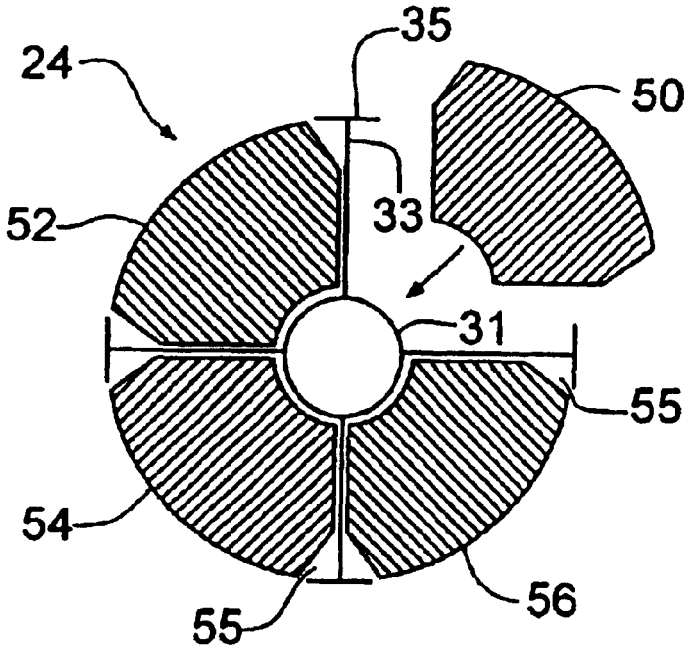
FIG. 5 shows a sectional view of an embodiment of the invention.

Referring now to FIG. 5, an alternative embodiment is seen in which the buoyancy system 24 comprises buoyancy units 50, 52, 54, and 56, that are slid radially between supports 33. Buoyancy unit 50 is shaped such that a space 55 is created between the buoyancy units, supports 33, and flanges 35. As will become more clear with reference to an example air-handling system, to be described below, space 55 includes, in some embodiments, a conduit for injecting air into each buoyancy unit 50, 52, 54 and 56, and a manifold, or means for evacuating water. It will be understood that while four buoyancy units are shown in the example of FIG. 5, other numbers of buoyancy units are used in alternative embodiments of the invention. In some embodiments, for example, there are more buoyancy units than there are support members 33. In other words, in some embodiments, buoyancy unit 50 comprises multiple, independent buoyancy units, for redundancy, ease of manufacturing, smaller tooling, and lower overall costs.

In various embodiments of the invention, buoyancy unit 50 comprises a composite material, which allows the use of air, rather than nitrogen, due to the non-corrosive nature of composite materials. Composite materials used to form the buoyancy unit are many, and any may be acceptable, depending on the particular environment in which such a buoyancy module is to be used. In any case, considerations of pressure, chemical stability with respect to the fluids with which the module will come in contact, and mechanical stresses the modules will experiences, determine when a particular material or combination of materials are appropriate. It has been found, however, that multi-layer composites are useful according to various examples of the present invention, in which some layers perform sealing functions to provide air/water isolation (e.g., polymeric liners, both inside and/or outside layers), while other layers perform strength functions for protection from puncture (e.g., thick, un-reinforced layers and/or layers of material differing from those of the adjacent layers, and/or layers having differing microstructures from other layers—honeycomb layers, etc.). Still other layers, in various embodiments, transfer the buoyant force to the riser. Some such layers are of engineered materials and comprise hoop layers (substantially horizontal orientation of fiber). Other layers comprise substantially axial orientation of fiber to carry axial loads. In still other embodiments there are further layers for wear resistance, where the module is anticipated to be in contact with abrading structures; and even fiber optics are included in some embodiments for monitoring of module conditions and other functions.

Any variety of combinations of layers are used in alternative embodiments of the invention; there is no particular layer combination that must be used in all embodiments of the invention. Further there is no particular single layer type that must be used in every embodiment of the invention. Many such modules are further described in U.S. patent application Ser. No. 09/643,185, filed Aug. 21, 2000, and incorporated herein by reference. In still other embodiments, buoyancy unit 50 comprises metal.

Figure 6:
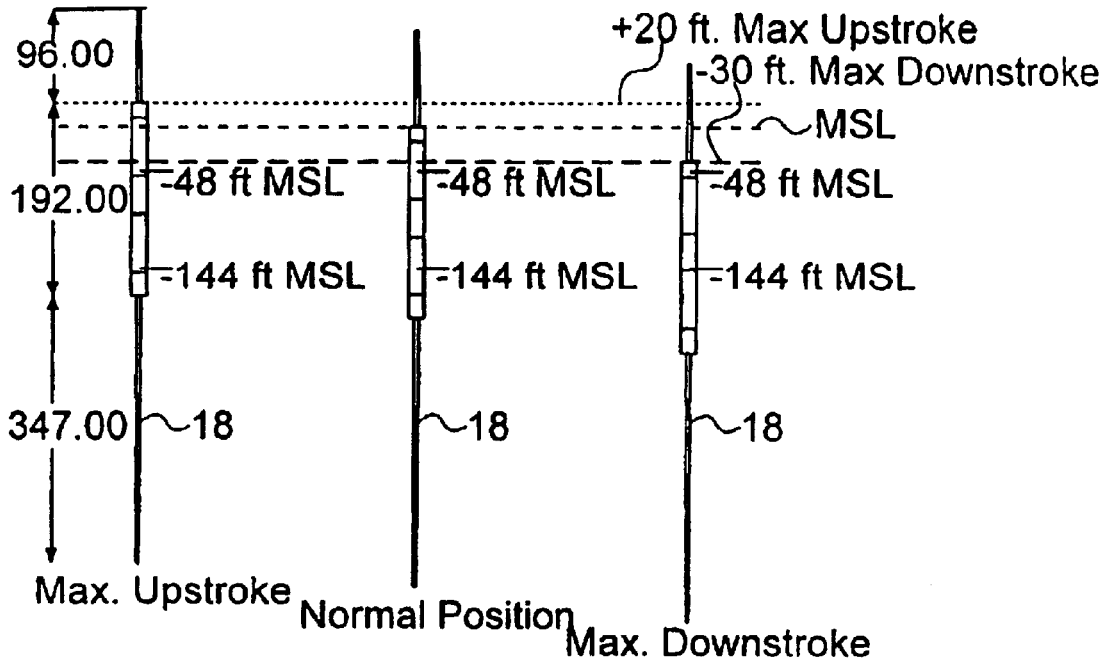
FIG. 6 shows a multi-state diagram of an embodiment of the invention.

To aid in understanding air-management of an example embodiment of the invention, riser stroke requirements are discussed with reference to FIG. 6, assuming that the riser moves a maximum of 20 feet upwards from its nominal position at mean sea level (MSL) and that the maximum downstroke is 30 ft below its nominal position at mean sea level. For every change in the elevation, there is a change in the internal pressure in the air chambers. If the pressure increases, the volume of air decreases; and, if the pressure decreases, the volume of air increases. This behavior is understood by those of skill in the art. It is desirable that substantially stable buoyancy be maintained during all ranges of upstroke and downstroke without the need for human intervention.

Figure 7A:
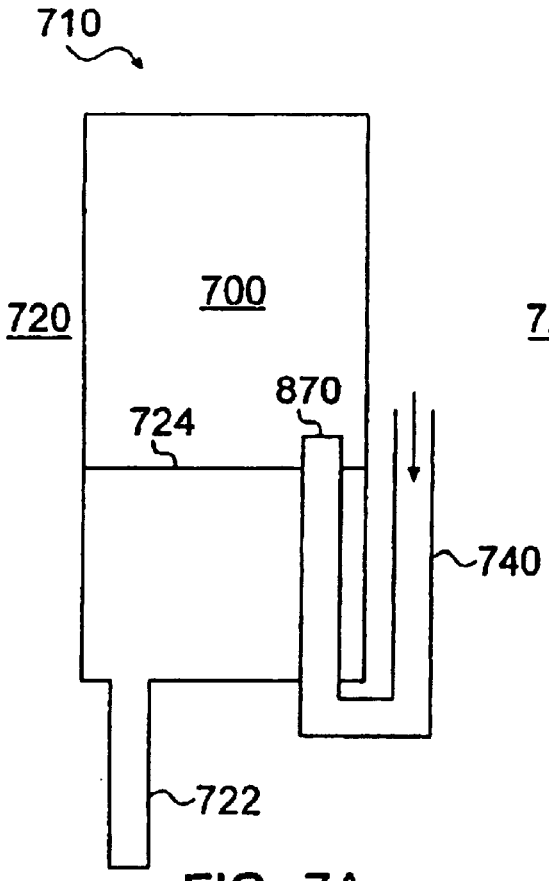
FIGS. 7A, 7B, 8A, and 8B, show representational views of embodiments of the invention.
Figure 7B:
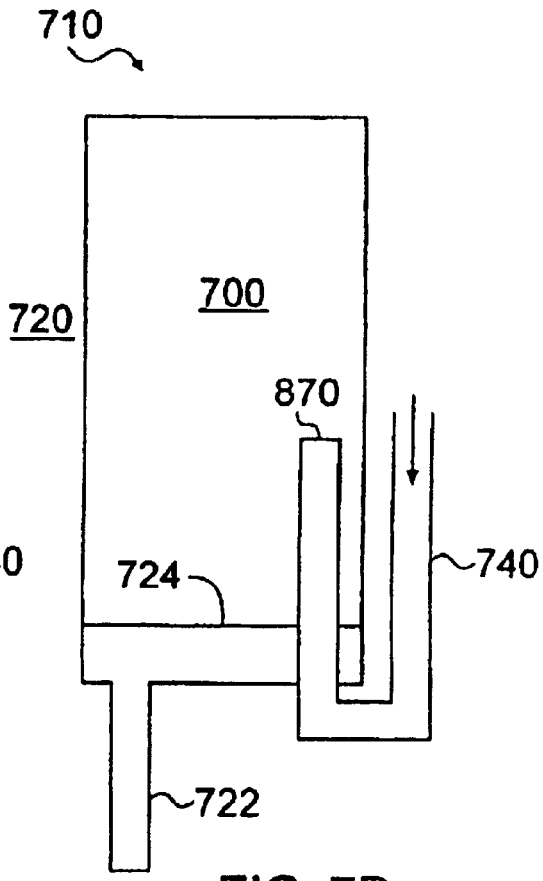

Referring now to FIG. 7A, in those operational situations where the system is rising in upstroke, the problem is relatively easy to handle. Namely, the air 700 will expand in the air chamber 710, pushing water into the ocean 720 through water outlet 722, as seen in FIG. 7B. until equilibrium is achieved with the water pressure at the lowest point in the system. However, air volume management is more problematic in the case of significant downstroke; the loss in air volume means a loss of buoyancy. The more buoyancy that is lost, the deeper the tensioning system sinks, until, eventually, the riser system hits a down-stop (not shown) mounted on the vessel structure.

Figure 8A:
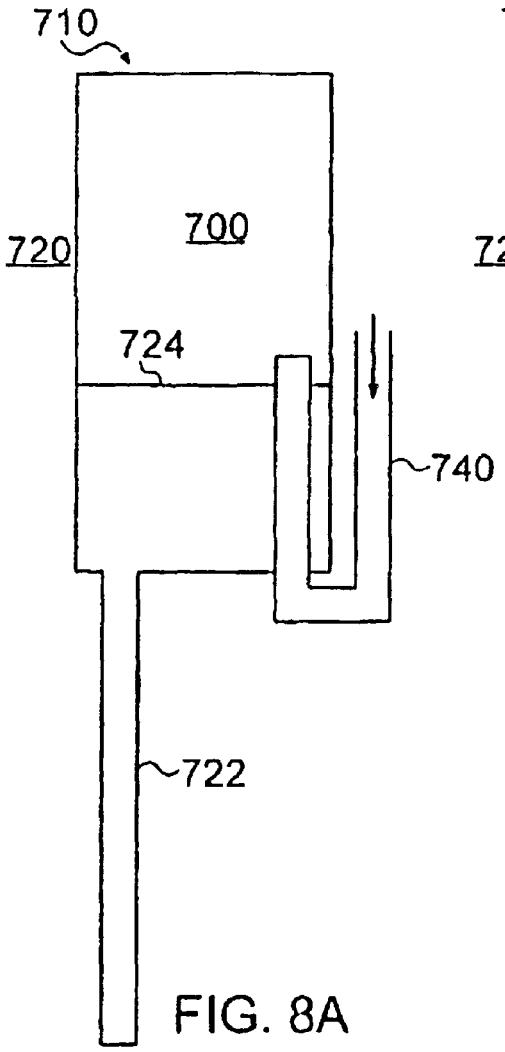
Figure 8B:
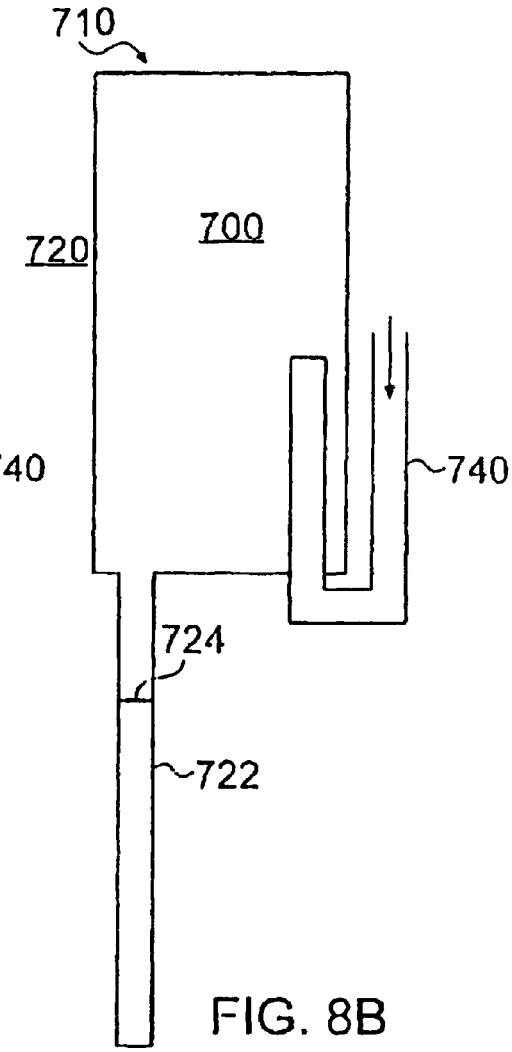

To reduce the loss of buoyancy during downstroke, the water level 724 inside the chamber 710 and its related volume fluctuate in the outlet 722 rather than in the air chamber 710. For example, in FIGS. 8A and 8B, two air-system example embodiments of the invention are seen. In the system of FIG. 8A, the water level 724 is stabilized inside the air chamber. Alternatively, as seen in FIG. 8B, the water level 724 is stabilized inside the water outlet pipe 722. In another state, each system of FIGS. 8A and 8B is further submerged an equal number of feet, with no increase in the air pressure. The water level 724 will rise an equal amount in each system, and the system of FIG. 8A suffers the greatest loss of buoyancy; the water level rises inside the main air chamber. The system of FIG. 8B experiences relatively little buoyancy loss; the water level rise is in the comparatively small volume of the water drain pipe 722.

For the reasons given above, buoyancy can designs in some embodiments of the invention have air outlet pipes 722 that extend downward a distance approximately equal to the maximum downstroke of the system. These systems are then pressurized through air inlets 740 so that the water level is stabile at the lower end of the pipe. As the system sinks in downstroke the water level 724 moves up the pipe 722 until it just enters the main air chamber 710 at maximum downstroke. In this manner, the buoyancy loss during downstroke is kept relatively small.

Figure 1:
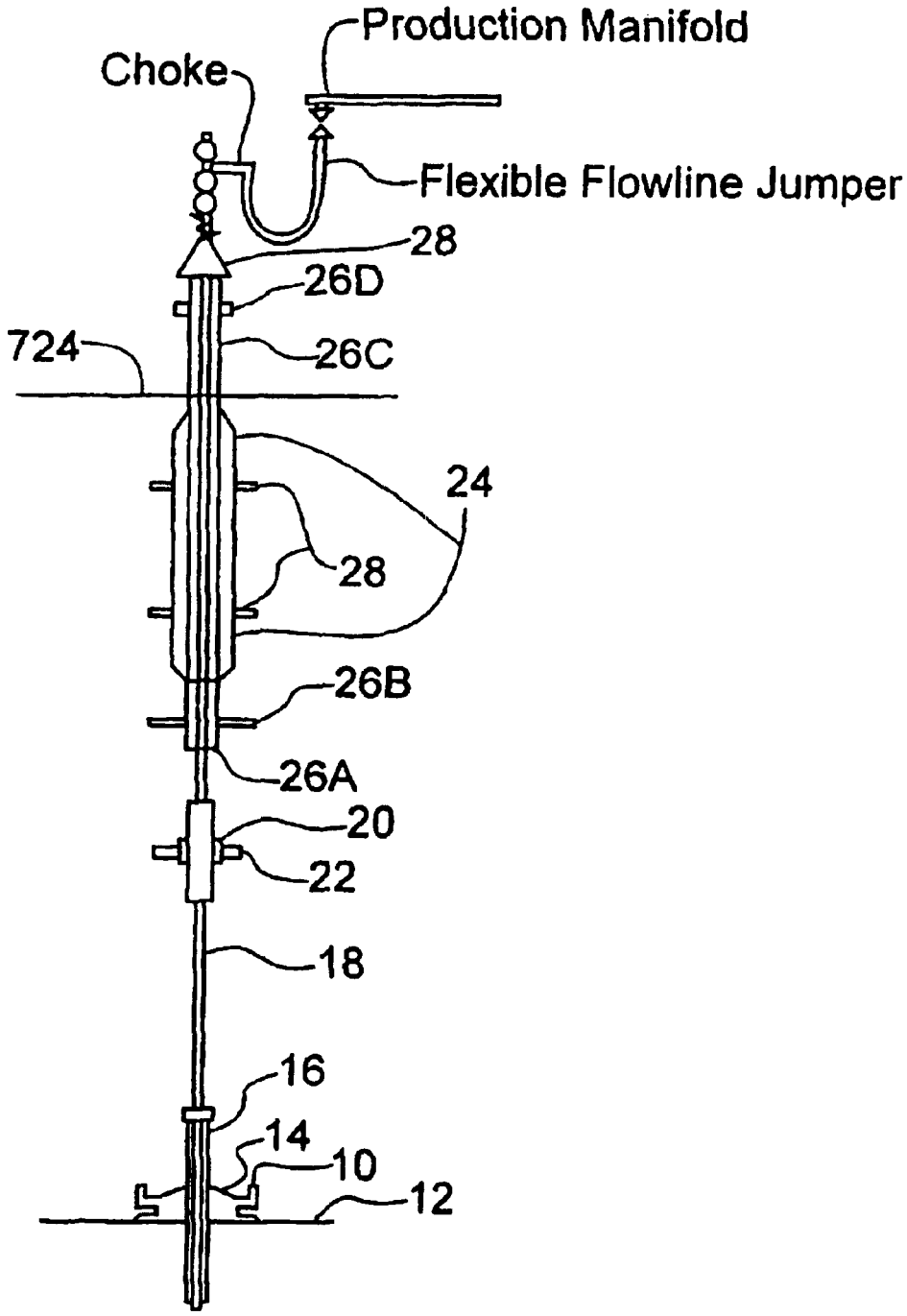
FIG. 1 shows a side view of an embodiment of the invention.
Figure 9:
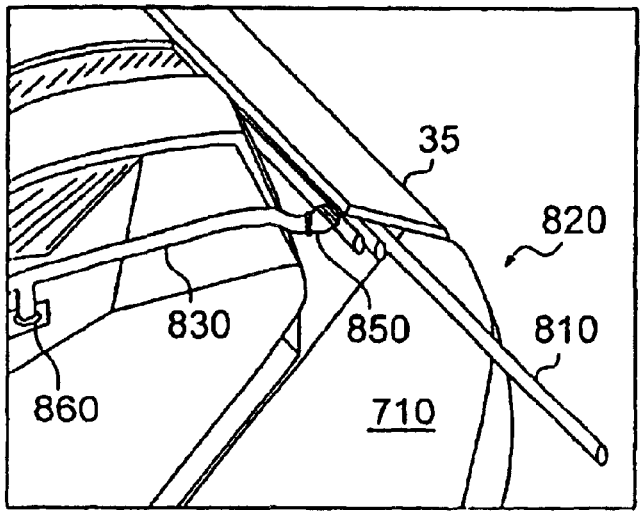
FIGS. 9 and 11 show perspective views of an embodiment of the invention.

According to still a further embodiment of the invention, illustrated in FIG. 9, inlet lines 810 comprise steel pipe that run from an air compressor on the topsides (not shown) down the upper stem (FIG. 1) to the first air chamber 710. The inlet lines 810 run underneath the flange 35.

The airline for a particular level of air chambers ends at the lower end 820 of the air chambers 710. There, the airline 810 is connected to an air manifold 830 made of, in one specific example, rubber hose with steel fittings 850. In turn, the air manifold 830 is connected to each of four air chambers 710 at that particular level. The air flows down the inlet line 810 and into air manifold 830. The air is then routed to each of the four air chambers 710 through the air manifold 830 at inlet ports 860.

Figure 10A:
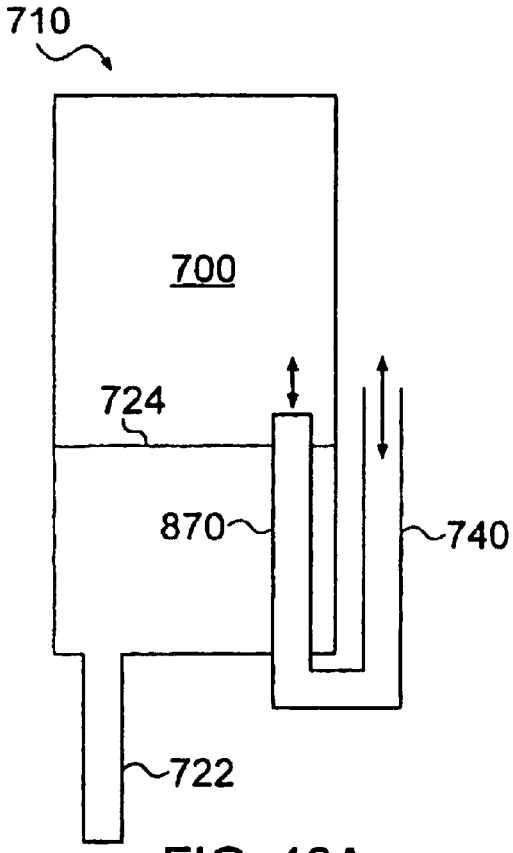
FIGS. 10A and 10B show representational views of embodiments of the invention.
Figure 10B:
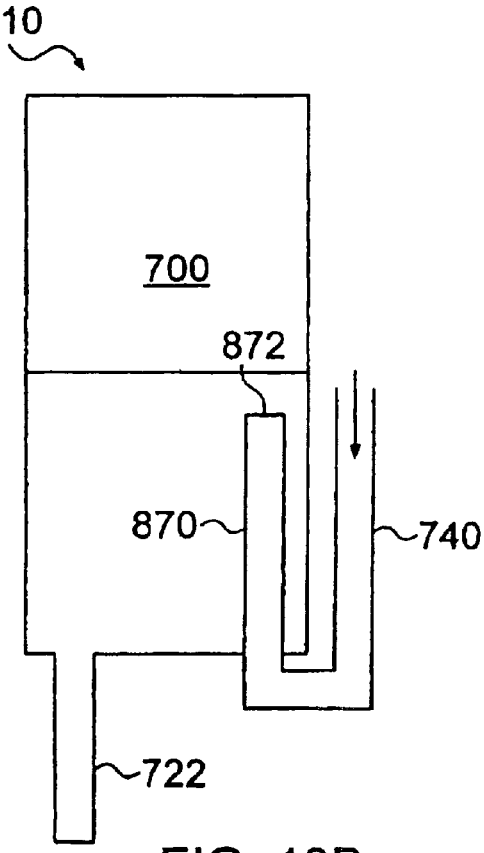

The air enters each chamber through a vertical pipe 870, as seen in FIGS. 10A & 10B, connected to inlet port 860 inside chambers 710. This pipe 870 runs the entire height of the chamber in some embodiments; alternatively, it is only a foot or so long in some other embodiments. The length of the vertical air pipe is determined by how much trapped air, if any, is needed inside a particular set of chambers for permanent buoyancy. The higher the tube runs inside the air chamber, the more air can be removed from the chamber. Pressurized air runs through the air manifold 830 (FIG. 9) into the vertical air tube 870 (FIGS. 10A and 10B) and out into the air chamber 710 where the water is displaced.

Figure 11:
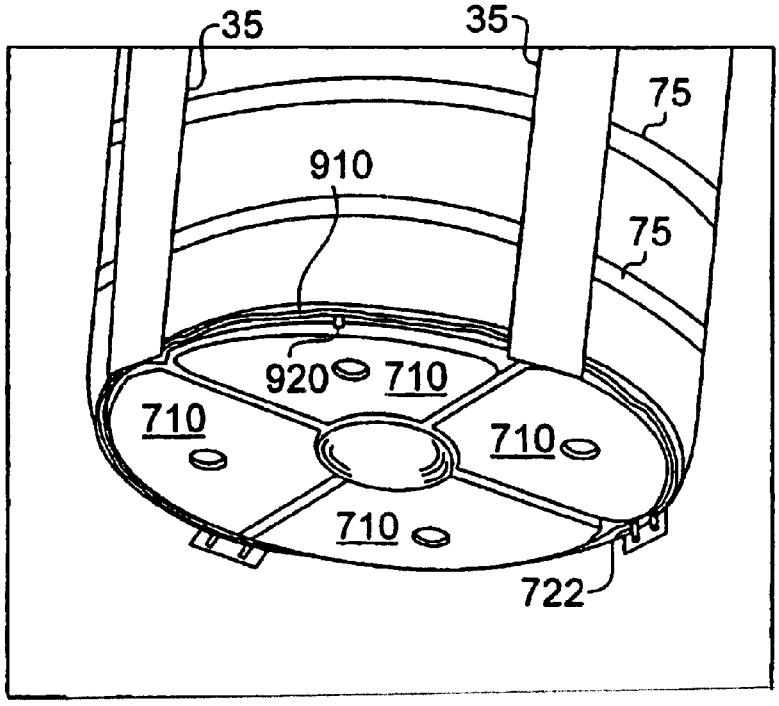

Referring now to FIG. 11, water exits the chamber 710 through the bottom of the chamber 710 and enters a water outlet manifold 910 through drain port 920. The outlet manifold 910 also comprises a rubber hose in one specific embodiment and runs circumferentially around the base of the air chambers 710. When the water outlet manifold 910 reaches an empty space in the pipe raceways located under the beam flanges 35 it turns to the vertical direction. The vertical length of the outlet pipe 722 (FIGS. 10A and 10B) extends from 0 to 30 ft, or more. depending on what kind of buoyancy characteristics are desired for that series of chambers, as explained in the previous section.

If it is necessary to flood one or more of chambers 710, then the air pressure is reduced in the air inlet line 810. The air flows backward through the air line 810, and this causes a drop in the air chamber pressure. Water enters through the drain pipe 722 into the water manifold 910 and back into the chambers 710. This process is continued in some embodiments until the mouth 872 (FIG. 10B) of the vertical air line 870 is covered with water and any residual air is permanently trapped in the top of the air chamber 710.

In the illustrated example embodiments, all connections to the air chambers 710 are located at the bottom of each chamber 710. This allows the chambers 710 to contain air, and retain near-normal function, even if a leak were to develop in one of the connections or manifolds. In the event of a severe leak, water floods the chamber 710 to the level of the leak and then seals the leak, preventing further air loss. Such operation could not be assured if the connections were located in the top of the air chambers.

Figure 12:
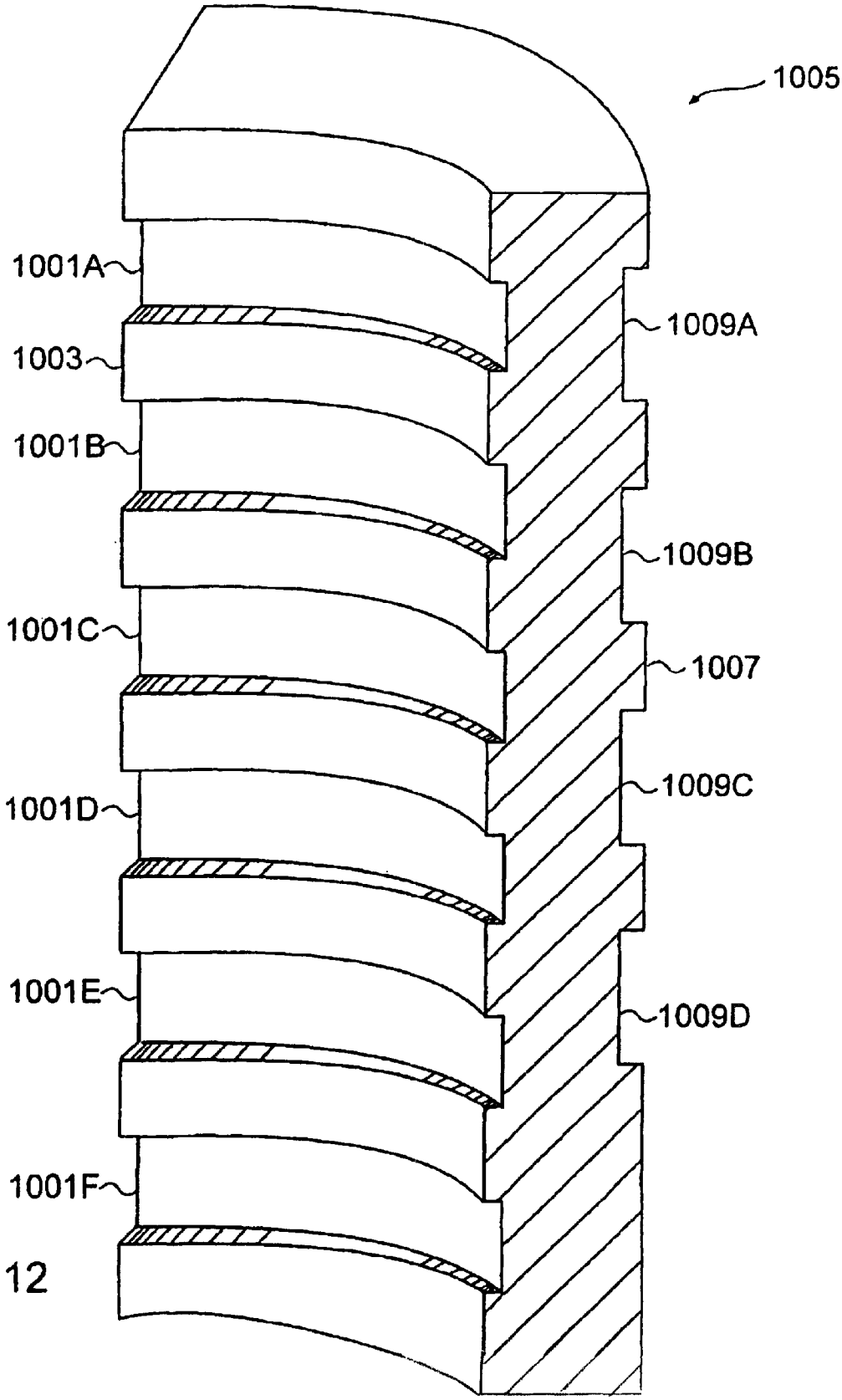
FIG. 12 shows a perspective view of an embodiment of the invention.

Referring now to FIG. 12, in one specific embodiment of the invention, buoyancy modules 50, 52, 54, 56 comprise a composite buoyancy module 1005 having stem side female recesses 1001A–1001F on the stem side 1003 of module 1005. As seen in FIG. 12, female recesses 1001A–1001F mate with rings 3A–3F surrounding stem 31, as shown in FIG. 3. Such a connection transfers the buoyancy force of the buoyancy module to stem 31. Thermosetting or other curable compounds are used in some embodiments to act as a liquid shim and to fill spaces or gaps between module 1005 and stem 31. Thermosetting and/or compounding reduces differential movement between the stem and the module 1005 and also a one-dimensional lock to assist in the transfer of buoyancy from the module to the item 31.

According to still another aspect of the invention, in some embodiments in which multiple buoyancy modules are inserted between supports 33 (e.g. FIGS. 3–5), the modules 50, 52, 54 and 56, and supports 33 are designed such that the outer surfaces of the modules 50, 52, 54 and 56, contact supports 33 in a substantially opposing manner, thus reducing out-of-plane loading.

Referring back to FIG. 11, it is seen that, in some embodiments, buoyancy units or chambers 710 are held in connection with support 33 (FIG. 3) by straps 75. Referring again to FIG. 12, exterior surface 1007 of module 1005 also includes female recesses 1009*a*–1009*d* which accept straps 75 (FIG. 11). Such straps 75 comprise synthetic material (e.g. Kevlar®), in some embodiments, and metal straps in some other examples. Straps 75 are used as a means for holding the modules to the frame, as seen in FIG. 11, and allow for ease of insertion and removal of modules from the frame, as seen in FIG. 5. Straps 75 also take some hoop-stresses from the modules 50–56 and help hold the modules 50–56 to the stem 31.

In alternative examples, mechanical fasteners (not shown) are used to secure buoyancy chambers 710 to frame 30.

It will be understood that the support 33 acts as a load-bearing system designed to resist side-loads and to transfer these side-loads to the riser system. The side-loads only occur at buoyancy can guide locations; and, thus, it should be understood that the internal frame 30 does not need to be at every location along the riser system to resist the side-loading.

The above embodiments have been given by way of example only. Further embodiments will occur to those of skill in the art which do not depart from the spirit of the invention, defined by the claims below,

What is claimed is:

1. In a buoyancy can assembly having a plurality of support members extending radially from a stem pipe having a plurality of circumferential rings, a composite buoyancy unit configured to be installed between adjacent support members and having a stem pipe side and an exterior surface, the composite buoyancy unit comprising:

a first plurality of recesses on the stem pipe side and configured to mate with the rings of the stem pipe; and a second plurality of recesses on the exterior surface of the buoyancy unit, the second recesses being configured to receive fasteners that secure the buoyancy unit to the support members.

2. The composite buoyancy unit of claim 1, wherein the exterior surface of the composite buoyancy unit is configured to engage the adjacent support members so as to reduce out-of-plane loading.

3. The composite buoyancy unit of claim 1, further comprising a curable compound between the stem pipe side of the composite buoyancy unit and the stem pipe.

4. The composite buoyancy unit of claim 1, wherein the fasteners are straps that fit into the second plurality of recesses and that are attached to the supports.

* * * * *